US008844776B2

(12) United States Patent
Haas et al.

(10) Patent No.: US 8,844,776 B2
(45) Date of Patent: Sep. 30, 2014

(54) BOTTLE CARTRIDGE

(75) Inventors: Richard E. Haas, Milford, OH (US); Mark D. Dalhart, Mason, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 510 days.

(21) Appl. No.: 12/915,756

(22) Filed: Oct. 29, 2010

(65) Prior Publication Data

US 2012/0104029 A1 May 3, 2012

(51) Int. Cl.
*B67D 3/00* (2006.01)
*B67D 7/02* (2010.01)

(52) U.S. Cl.
CPC ..... *B67D 7/0294* (2013.01)
USPC ..... 222/481.5; 222/1; 222/325; 222/464.1; 222/547

(58) Field of Classification Search
USPC ..... 222/1, 481.5, 325, 546–547, 518, 222/464.1, 482; 220/202
See application file for complete search history.

(56) References Cited

U.S. PATENT DOCUMENTS

| | | | | | |
|---|---|---|---|---|---|
| 4,646,945 | A * | 3/1987 | Steiner et al. | ..... | 222/207 |
| 4,862,918 | A * | 9/1989 | Schroeder | ..... | 137/614.19 |
| 5,165,578 | A * | 11/1992 | Laible | ..... | 222/189.09 |
| 5,890,517 | A * | 4/1999 | Laible | ..... | 137/614.04 |
| 5,988,456 | A * | 11/1999 | Laible | ..... | 222/464.1 |
| 6,543,654 | B1 * | 4/2003 | Uhl et al. | ..... | 222/464.1 |
| 6,619,318 | B2 * | 9/2003 | Dalhart et al. | ..... | 137/565.34 |
| 6,669,062 | B1 * | 12/2003 | Laible | ..... | 222/464.1 |
| 6,968,983 | B2 * | 11/2005 | Laible | ..... | 222/464.1 |
| 6,986,443 | B2 * | 1/2006 | Laible | ..... | 222/181.1 |
| 7,513,395 | B2 * | 4/2009 | Labinski et al. | ..... | 222/481.5 |
| 7,537,140 | B2 * | 5/2009 | Lin | ..... | 222/321.7 |
| 8,083,107 | B2 * | 12/2011 | Laible | ..... | 222/478 |

* cited by examiner

*Primary Examiner* — Frederick C Nicolas
(74) *Attorney, Agent, or Firm* — Wood, Herron & Evans, LLP

(57) ABSTRACT

A bottle cartridge fits in the neck of a bottle providing liquid flow and venting from the bottle interior when operably connected to a dispenser, and preventing spills or leakages upon any bottle upset. Dual seals are provided; a valve core is operated by connecting the cartridge to a dispenser coupling. Cartridge materials are disclosed.

20 Claims, 6 Drawing Sheets

BOTTLE CARTRIDGE

FIELD OF THE INVENTION

This application relates to chemical distribution and more particularly to a valved bottle cartridge for a chemical source container used in a chemical proportioning dispenser system.

BACKGROUND OF THE INVENTION

It is known to supply chemicals to a proportioning dispenser in bottles or plastic containers having open mouths at their upper ends. Cartridges or inserts are placed in the mouths to seal off the contents, prevent spillage and provide an interface with a dispenser and through which chemical can flow when the bottle is operably oriented to a station in a dispenser or otherwise interconnected to a dispenser. One such cartridge is shown in applicant's U.S. Pat. No. 6,619,318 which is incorporated herein by reference. Another is shown in U.S. Pat. No. 5,988,456, also incorporated herein by reference.

Desired function of such inserts is twofold. First, it is desirable to provide an insert which prevents or substantially reduces any chemical leakage, should the container be overturned. Secondly, it is desirable to provide a cartridge which readily flows chemical when properly connected to a dispenser, and without seepage of air into the chemical flow.

Prior cartridges have been found useful, however, there are desirable improvements in the areas of the valve, the seals, the venting and other structural and functional aspects of such cartridges.

Accordingly, it is desirable to provide a bottle cartridge with an improved valve for passing chemical out of the bottle or container when the cartridge is operatively connected to a dispenser component of a dispensing system or propotioner.

It is further desirable to provide an improved one-way air intake for use when chemical is drawn from the bottle.

It is also desirable to provide an improved bottle cartridge having improved sealing and operational methods.

It is also desired to provide an improved bottle cartridge allowing venting when chemical is withdrawn, yet preventing or minimizing spillage if the container is overturned.

SUMMARY OF THE INVENTION

To these ends, the invention contemplates a bottle cartridge or container mouth insert having a normally closed spring-loaded valve core operable to an open position when connected to a dispenser. When the core is moved to a closed position, the cartridge vents the bottle or container through an open cartridge mouth, around a valve core flange and through a vent passage in the cartridge body.

When connected to a dispenser and in open condition, the bottle mouth is sealed by a dispenser coupling or cap. Venting during chemical withdrawal occurs through a one-way valve in the dispenser coupling, and again around the valve core flange and through an aperture in the cartridge body.

Any spillage through the aperture and around the valve core flange is minimized on bottle or container turn over.

Moreover, the cartridge body and the valve core define dual seals and sealing surfaces respectively, active when the cartridge is open and one active when the cartridge is closed, thus enhancing sealing for any operative configuration of the cartridge.

Thus, when the valve core is spring-biased to its closed position, the core seals to the cartridge in one seal area and any venting is around the core flange and through the cartridge body aperture. When the core is moved to its open position by connection to a dispenser coupling, venting is through the dispenser coupling and again around the core flange and through the cartridge body aperture. In both cases, the core is sealed to the cartridge, preventing leakage therepast of chemical on any tipping or turn over and, as well, sealing against air seepage into any dispensing chemical flow when the core is in an open position.

It has also been desired to overcome any natural "stiction" or unwanted friction between the seals of the cartridge and the sealing surfaces of the valve core, and which might interfere with the operation of the valve defined by these components.

Accordingly, it is desirable to provide both improved cartridge and valve core without any inherent friction or "stiction" characteristics as would interfere with desired valve operation. It is also desirable to provide an integral cartridge with sufficient rigidity for positive capture in a bottle mouth, yet of sufficiently softer characteristic to provide adequate sealing with the valve core.

To this end, the invention contemplates a cartridge body comprising a mix of 80% polypropylene and 20% polyethylene and a valve core of lubricated acetate. The polypropylene is relatively stiff, while the polyethylene is relatively softer. This combination provides a cartridge which is sufficiently soft and flexible in the seal area, but is also sufficiently rigid to provide a snap fit of the cartridge into the surrounding bottle mouth. The lubricated acetate provides a hard material to interact with the sealing surfaces in the cartridge body and the lubrication reduces the "stiction" between the surfaces. Preferably the dispenser coupling or overcap can be of polyethylene material and the umbrella-shaped, one-way air valve element in the cap is preferably of an EPDM material.

Accordingly, the invention provides a significantly improved bottle cartridge for chemical dispensing and related methods.

These and other benefits and advantages will become even more readily apparent from the following written description in which:

DETAILED DESCRIPTION OF THE INVENTION

It will be understood the terms "bottle" and "container" are used interchangeably to refer to a chemical reservoir or supply having a mouth typically at an upper end thereof. The terms "cartridge" and "insert" are herein used interchangeably to refer to the invention described herein. The term "dispenser" is used to refer to any device of the type used to draw or receive concentrated chemical from a bottle for proportioning, dispensing or both. The terms "dispenser coupling" or "dispenser cap" are used to refer to structure for connecting the bottle or bottle cartridge to the dispenser, whether in a fixed docking station or merely in a coupling operatively connecting the cartridge and bottle to a tube for conducting concentrated chemical to a dispenser or other form of chemical use apparatus not typically referred to as a dispenser. Accordingly, the "dispenser coupling" or "dispenser cap" could also be defined by a connector or overcap for connecting a tube through the cartridge for chemical flow therethrough, the cap, when applied to a bottle mouth, operating the valve core of the cartridge to an open position. When the cap is removed, the valve core of the cartridge is spring-biased to a closed position.

Figure 1:
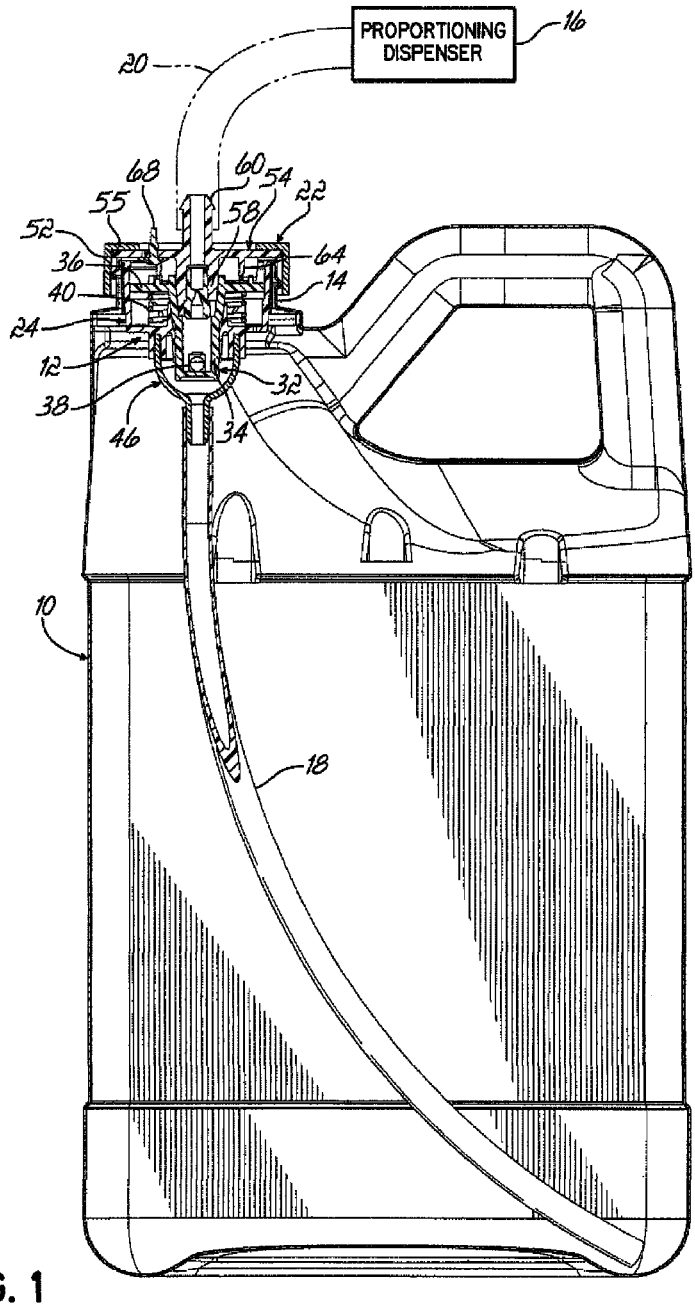
FIG. 1 is an elevational view in partial cross-section illustrating the invention in a bottle mouth and interconnected to a dispenser coupling.
Figure 1A:
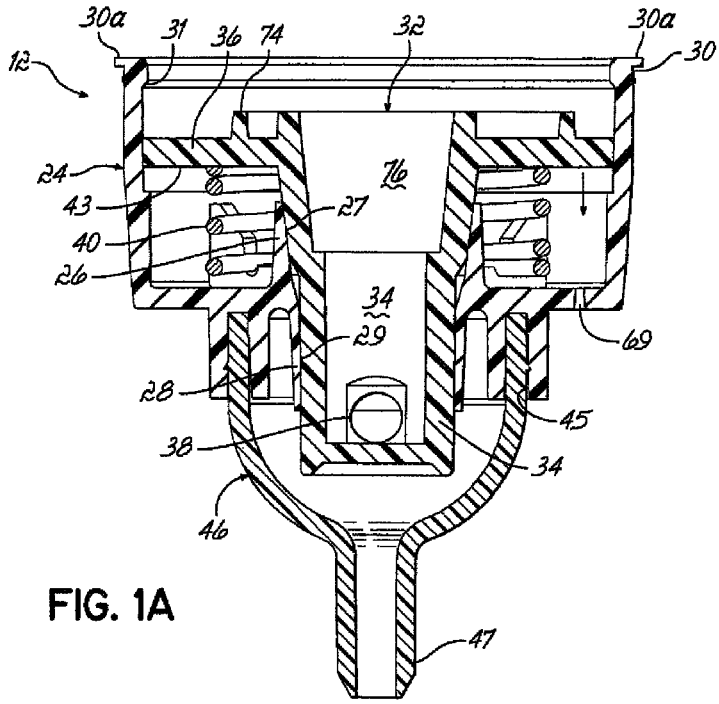
FIG. 1A is an elevational view in cross-section of the invention of FIG. 1 in the open position.
Figure 6:
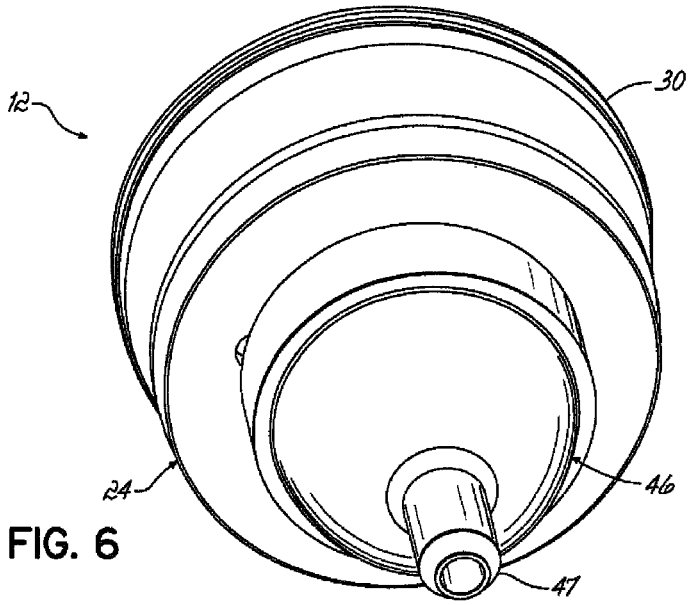
FIG. 6 is a perspective upward view of the bottom of the bottle cartridge of FIGS. 1-5.

Turning now to FIG. 1, a chemical source container such as a jug or bottle 10 is illustrated with a bottle cartridge or insert 12, illustrated in operative position within mouth 14 of bottle 10. Cartridge 12 operatively interfaces with mouth 14 of bottle 10 to provide an operative means by which liquid chemical concentrate (not shown) within bottle 10 can be communicated to a proportioner or dispenser 16. Chemical is sucked up from bottle 10 through suction or pick-up tube 18, passed through insert 12 and transmitted through appropriate fittings or tube 20 to the dispenser 16, preferably for dilution and discharge for use in a diluted form.

Figure 2:
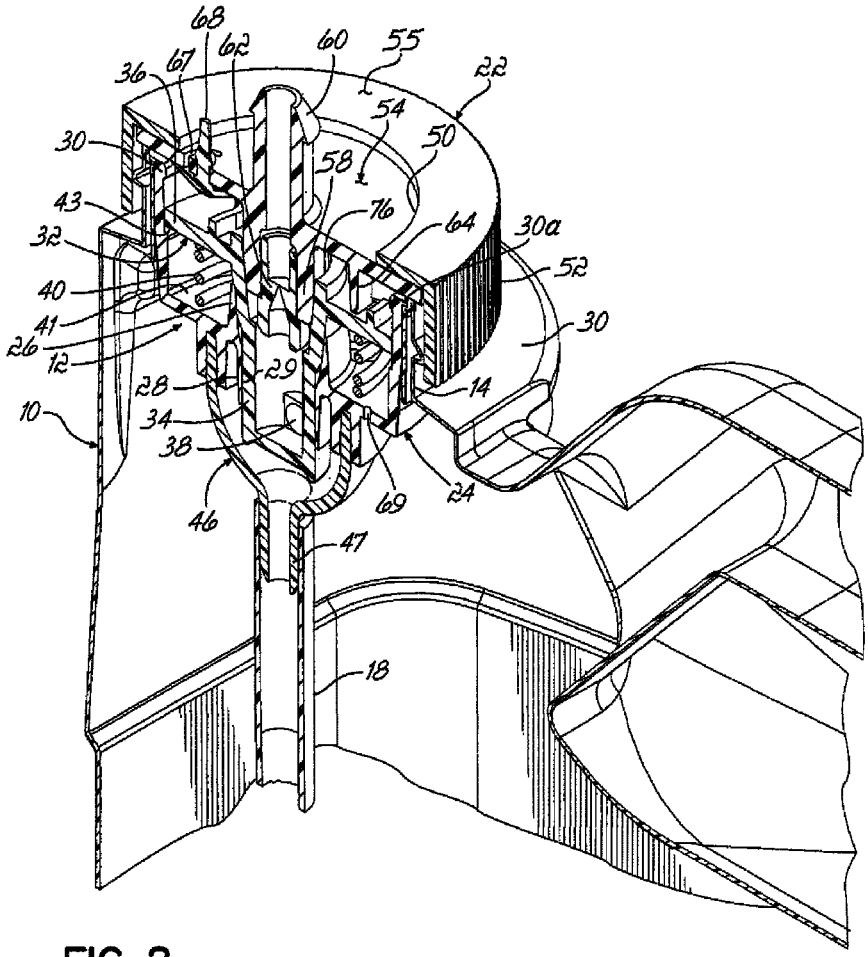
FIG. 2 is a perspective view in partial cross-section of the invention of FIG. 1 in open configuration.
Figure 3:
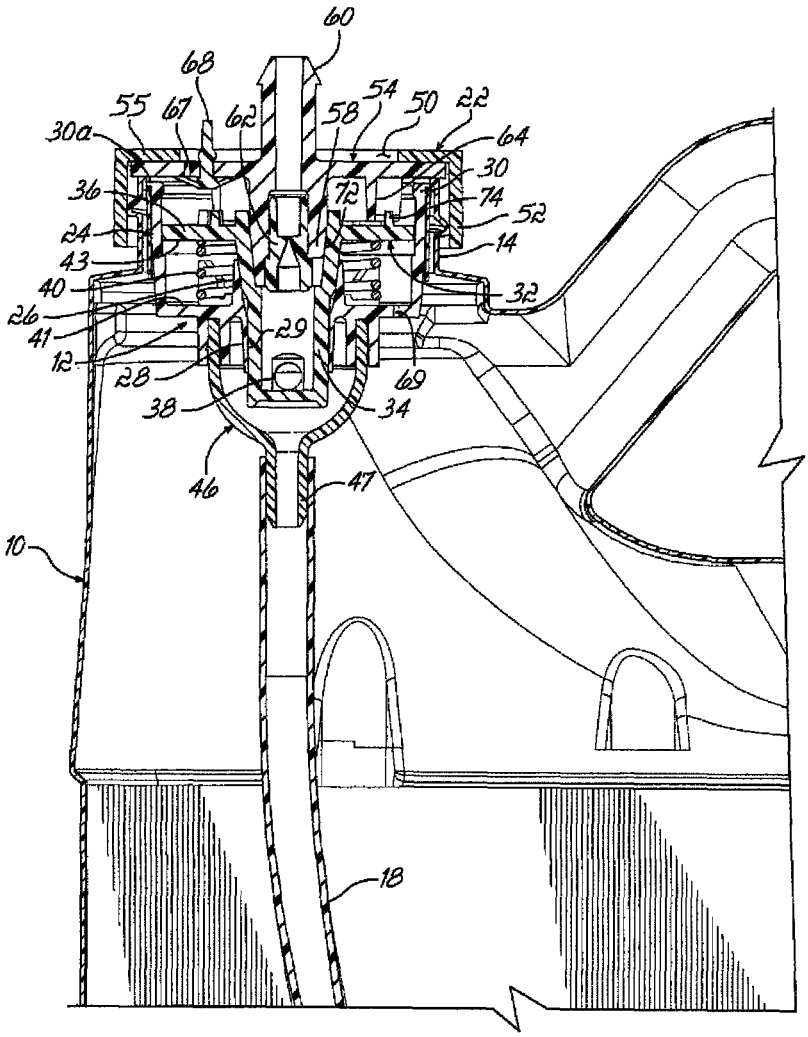
FIG. 3 is an elevational view in cross-section of the invention of FIG. 2.
Figure 4:
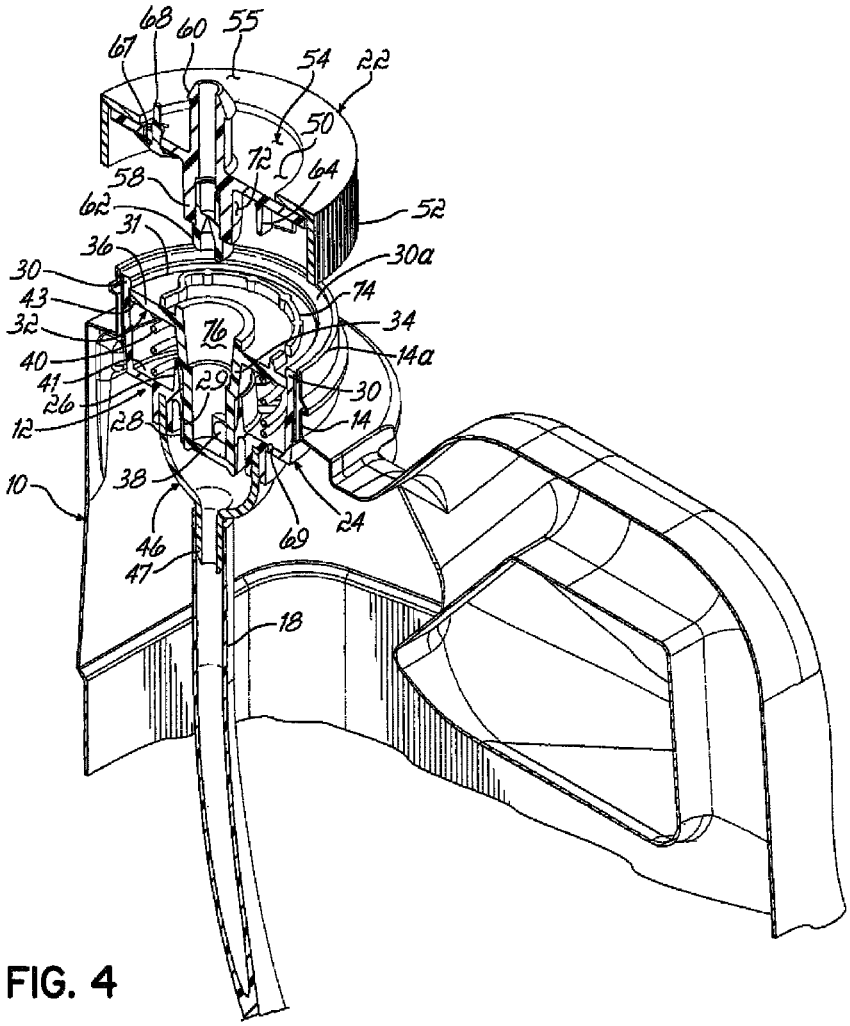
FIG. 4 is a perspective view in partial cross-section of the invention of FIG. 1 but showing the invention in closed configuration with a dispenser coupling shown in exploded view.
Figure 5:
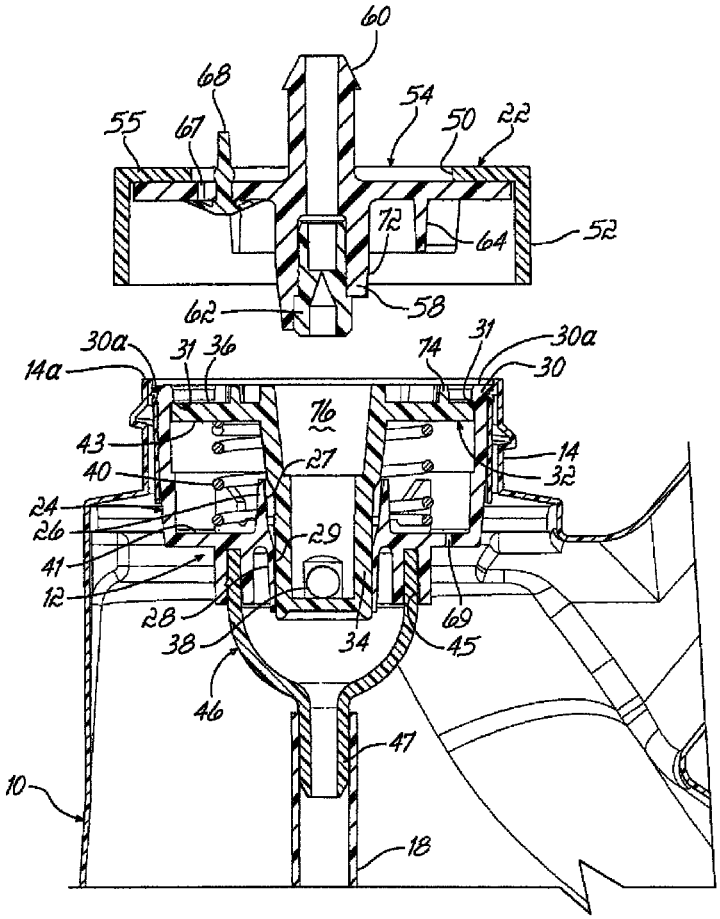
FIG. 5 is an elevational cross-section view of the invention as in FIG. 4.

As shown in FIGS. 1-3, the cartridge or insert 12 is in place with mouth 14 of bottle 10. It will be appreciated that bottle 10 is deliverable with externally threaded mouth 14 covered by a closure (not shown) until it is desired to operatively interconnect the bottle 10 to a dispenser 16 through a dispenser component such as cap 22 as shown in FIGS. 4-5, which is internally threaded (not shown) for operative positioning by twisting onto mouth 14. That mouth 14 has a rim portion 14*a* (see FIGS. 4 and 5) defining an upper edge of mouth 14 as shown in the FIGS.

The closure (not shown) can be sealed over mouth 14 as described, whether or not cartridge 12 is in place within the mouth 14. Accordingly, filled bottles 10 can be transported in leak-free condition, whether or not a closure cap is in place. Moreover and as will be described, once cartridge 12 is in place with mouth 14, the cartridge 12 prevents leakage, even when there is no closure cap, and as will be described.

It will be appreciated that bottle 10 can be of any suitable configuration such as that shown in the Figures or in any other configuration, and presenting a mouth, preferably such as mouth 14.

With reference to FIGS. 1-6, details of the cartridge will now be described. It will be appreciated that for descriptive purposes, the insert 12 and cap 22 cooperate together as in FIGS. 1-3 to provide for flow of chemical concentrate to dispenser 16. The cap 22 is shown in exploded view of FIGS. 4 and 5 for clarity.

Insert or cartridge 12 includes an insert body 24 defining a first seal 26 comprising a first seal surface 27 and a second seal 28 comprising a second seal surface 29. Seals 26, 28 define a circular, tapered bore of varied diameter as shown, with the seal surfaces 27, 29 comprising walls of that bore.

At the upper end 30 of insert body 24 is a circular lip 31. Above lip 31 is an upper rim surface 30*a* of a cartridge 12 (FIGS. 1*a*, 2-5) which is oriented below rim portion 14*a* of mouth 14 as shown in FIGS. 4 and 5.

A valve core 32 includes a hollow valve core 34 and an integral flange 36 from which core 34 depends. Core 34 is provided with one or more fluid passages 38.

When the valve 32 is in its closed position, the core 34 is raised so that passage 38 is within the second seal 28, preventing passage of chemical concentrate therethrough into the hollow interior of core 34. FIGS. 4 and 5 depict this condition.

When the valve 32 is in open position, the core 34 is lowered and the passage 38 extends below the second seal 28 and second seal surface 29, opening the hollow core 34 for passage of chemical concentrate. FIGS. 1-3 illustrate this condition of insert 12.

A spring 40 is operably disposed between a floor 41 of insert body 24 and the underside 43 of flange 36 of valve body 32. Spring 40 biases flange 36 upwardly into engagement with retaining lip 31 of insert body 24.

It will be appreciated that insert body 24 is circular in shape and sized to provide a friction or snap-in fit within mouth 14. Also, insert body 24 is provided with appropriate recesses as at 45 to receive the upper circular end of a lower funnel-like cap 46 having a tip 47 for connection to pick-up tube 18.

Turning now to cap 22, the preferably round cap has a circular opening 50 in top 55 and a depending annular skirt 52, with internal threading (not shown), cooperating with the external threads of mouth 14 so the cap 22 can be twisted or screwed into place on mouth 14.

An actuating plate 54 is disposed beneath the top 55.

Plate 54, preferably, also defines a depending hollow boss 58 and an upstanding connection nipple 60 for connection to a concentrated chemical discharge tube 20 (FIG. 1). Optionally, a metering tip 62 (diagrammatically shown in the FIGS.) is included for metering concentrated chemical passing through insert 12, but the invention may be used without such tip.

Plate 54 also includes a one-way vent hole 67 closed against fluid movement out of cap 22 by flexible flap valve member 68. Air can be pulled into insert 12 through vent 67, around flange 36 and through body 24 and into bottle 10 through a vent hole 69 upon concentrated chemical being drawn from bottle 10. Chemical cannot escape in a reverse flow, however, should bottle 10 be upset as member 68 closes vent 67 against outward flow, flexing away from vent 67 only upon a reverse pressure differential in the opposite direction.

Finally, it will be appreciated that plate 54 provided with the depending hollow boss 58 with an outer surface 72 that engages with the interior surface 76 of boss 34 extending upwardly from flange 36 to facilitate reciprocal, non-tilting movement, of flange 36 when urged downwardly by application of cap 22 and plate 54 as the cap 22 is screwed onto bottle mouth 14.

Operation of the insert 12 is as follows. When no cap 22 is screwed on mouth 14, and assuming insert 12 is installed in mouth 14, as in FIGS. 4 and 5, valve body 32 is in its raised, valve-closed position. Here, the lower end of core 34 is disposed within the second seal area of body 32 with the lower end of the core engaging the second seal surface 29.

In this position, passage 38 is sealed off by surfaces 29. When cap 22 is screwed onto mouth 14, the depending actuating boss 58 of actuating plate 54 engages the flange 36 of valve core body 32 and pushes core 32 downwardly.

In this valve-open position (FIGS. 1-3) an upper end of core 34 engages first seal 26 and sealing surfaces 27, and a lower end of core 34 engages second seal 28 and surfaces 29. However, passage 38 of core 34 is now disposed below second seal 28 and seal surfaces 29. This opens the hollow interior of the core 34 to the concentrated chemical within lower cap 46, fed by pick-up tube 18. Concentrated chemical can thus flow up tube 18, into cap 46, through passage 38, into core 34, up through metering tip 62, through actuating plate 54 and nipple 60 to a dispensing apparatus.

In this valve open position, note that outer surfaces of core 34 are sealed off by both first seal 26 and second seal 28.

Also note that the outer surface 72 of boss 58 is now sealed to inner surface 76 of core 34. Thus, the only flow passage of any concentrated chemical out of bottle 10 is through core 34 and nipple 60, with all other surfaces being sealed. Thus, even if bottle 10 is tipped over after application of cup 22, there is no leakage.

On removal of cap 22, spring urges flange 36 upwardly, core 34 rises, fluid passage 38 is sealed, and there is no leakage from bottle 10.

As noted, when cap 22 is functionally applied to mouth 14 and concentrated chemical is being withdrawn from bottle 10, any vacuum produced in bottle 10 is relieved by air flowing through vent 67 past one-way valve 68 around flange 36 into insert and through vent 69. That passage is closed off upon removal of cap 22 and closure of flange 36 against lip 31.

Finally, and in order to facilitate the operation of core 32 reciprocally in valve body 12, it will be appreciated these components are formed of mutually cooperative materials preferably comprising a mixture of about 80% polypropylene and 20% polyethylene for the body 12 and lubricated acetate for the core 32.

This provides sufficient flexibility and softness in the seal areas, but is of sufficient rigidity to facilitate substantial fit of insert 12 into mouth 14. Preferably, the cap 22 may be made from a suitable material such as a polypropylene, while the valve member 68 is made preferably from an EPDM mat.

Accordingly, the invention provides and attains the goods, benefits and advantages described herein.

These and other modifications and variations of the invention will be readily appreciated by the foregoing to those of ordinary skill in the art without departing from the scope of the invention and applicant intends to be bound only by the claims appended hereto.

What is claimed is:

1. A bottle cartridge comprising:

a cartridge body;

a first resilient valve seal defined integrally in said cartridge body;

a second resilient valve seal defined integrally in said cartridge body;

a valve core, said valve core having first and second sealing surfaces;

a fluid passage in said valve core, said fluid passage having a fluid port operably communicating therewith;

said valve core moveable between respective closed and open positions;

said valve core in said open position having both first and second sealing surfaces respectively, in sealing contact with said first and second resilient valve seals; said port oriented at a position beyond said seals for passage of fluid through said fluid passage in said core; and said valve core in said closed position having said first sealing surface spaced from said first resilient valve seal.

2. A bottle cartridge as in claim 1, wherein said valve core in said closed position having at least said second sealing surface in sealing contract with said second resilient valve seal; and wherein said port is sealed by said second resilient valve seal.

3. A bottle cartridge as in claim 1 wherein said first and second resilient valve seals are coaxially disposed in tandem.

4. A bottle cartridge as in claim 3 wherein said first and second sealing surfaces of said core are coaxially disposed with respect to each other and are in tandem.

5. A bottle cartridge as in claim 4 wherein said first and second resilient valve seals and said first and second sealing surfaces are all in coaxial disposition with respect to each other.

6. A bottle cartridge as in claim 1 wherein said valve core has a valve flange disposed within said cartridge body and further including a valve spring operatively disposed between a portion of said cartridge body and said flange and biasing said valve core to a closed position.

7. A bottle cartridge as in claim 6 wherein said cartridge body includes a fluid passage operably communicating with an interior space in said body partially defined by said body and said flange, and with an extension of said cartridge when said cartridge is disposed in a bottle.

8. A bottle cartridge as in claim 1 further including the combination therewith of a dispenser connector having a connector flange with an air passage therethrough operatively communicating between both sides of said connector flange.

9. A bottle cartridge comprising:

a cartridge body;

a first resilient valve seal defined integrally in said cartridge body;

a second resilient valve seal defined integrally in said cartridge body;

a valve core, said valve core having first and second sealing surfaces;

a fluid passage in said valve core, said fluid passage having a fluid port operably communicating therewith;

said valve core moveable between respective closed and open positions;

said valve core in said open position having both first and second sealing surfaces respectively, in sealing contact with said first and second resilient valve seals; said port oriented at a position beyond said seals for passage of fluid through said fluid passage in said core;

said valve core in said closed position having said first sealing surface spaced from said first resilient valve seal; and further including the combination therewith of a dispenser connector having a connector flange with an air passage therethrough operatively communicating between both sides of connector flange;

further including a resilient, one-way air valve operably disposed over said air passage, permitting air flow toward said cartridge and restricting fluid flow from said cartridge.

10. A vented coupling cap for a bottle cartridge, said cap including a cap flange, a first flange surface exposed to atmosphere, and a second opposed flange surface, and a fluid passage in said flange extending between said surfaces; a flexible valve disposed over said passage on said second opposite surface for passing fluid through said flange from said first to said second surface; further including a boss depending from said flange for operating a valve core in said bottle cartridge.

11. A vented coupling cap as in claim 10 further including an over cap engaging said flange for holding said flange in operative valve core operating position.

12. A vented coupling cap as in claim 11 further including a fluid passage extending through said boss.

13. A vented coupling cap as in claim 12 further including an extension from said boss from said first flange side for connection to a fluid tube.

14. A vented cap as in claim 10 in combination with a bottle cartridge disposed in a mouth of a bottle, said mouth having a rim portion and said cap holding said flange in sealing relation to said rim portion of said mouth.

15. A vented cap as in claim 10 wherein said bottle cartridge has an upper rim wherein said mouth has a rim portion and wherein said flange sealingly engages said rim portion of said mouth in a position spaced from and above said cartridge upper rim.

16. In combination, a bottle having a mouth with a mouth rim portion, a bottle cartridge having an upper rim, said cartridge disposed in said bottle mouth, and a vented cap on said bottle over said cartridge, said cap sealing on said mouth rim portion and said cap and said upper rim of said cartridge being spaced apart, wherein said cartridge upper rim is disposed in said mouth below said mouth rim portion of said bottle mouth, wherein said cartridge comprises a cartridge body defining coaxial first and second resilient seals, a spring-biased valve core in said cartridge having first and second sealing surfaces on said core, and a connecting cap comprising a flange and a depending boss engaging and moving said core from a biased closed to an open position, when oriented on said mouth, wherein said first and second sealing surfaces respectively engage said first and second resilient seals.

17. A method of closing a bottle mouth for controlled flow of fluid therethrough and comprising the steps of:

inserting a bottle cartridge in said mouth, said bottle mouth having a mouth rim and said cartridge having an upper rim proximate but spaced from said mouth rim, said cartridge having a valve core with first and second sealing surfaces and said cartridge defining first and second seals;

applying a connector cap to said bottle mouth, said cap having a flange, and sealing said cap flange to said mouth rim, in a plane spaced from a plane in which lies the cartridge upper rim; and engaging and moving said valve core with said connector cap to an open position wherein said first and second sealing surfaces respectively engage said first and second seals in sealing relation.

18. A method of closing a bottle mouth for controlled flow of fluid therethrough and comprising the steps of:

inserting a bottle cartridge in said mouth, said bottle mouth having a mouth rim and said cartridge having an upper rim proximate but spaced from said mouth rim, said cartridge having a valve core with first and second sealing surfaces and said cartridge defining first and second seals;

applying a connector cap to said bottle mouth, said cap having a flange, and sealing said cap flange to said mouth rim, in a plane spaced from a plane in which lies the cartridge upper rim; and engaging and moving said valve core with said connector cap to an open position wherein said first and second sealing surfaces respectively engage said first and second seals in sealing relation and further including passing air through a one-way vent in said cap, around said flange and outwardly through a passage in said cartridge into a bottle when fluid is withdrawn from said bottle, said seals and sealing surfaces blocking passage of air into said fluid.

19. A method as in claim 18 including passing fluid from a bottle through said valve core and said cap.

20. In combination, a bottle having a mouth with a mouth rim, a bottle cartridge having an upper rim, said cartridge disposed in said bottle mouth, and a vented cap on said bottle over said cartridge, said cap sealing on said mouth rim and said cap and said upper rim of said cartridge being spaced apart, wherein said cartridge comprises a cartridge body defining coaxial first and second resilient seals, a spring-biased valve core in said cartridge having first and second sealing surfaces on said core, a connecting cap comprising a flange and a depending boss engaging and moving said core from a biased closed to an open position wherein said first and second sealing surfaces respectively engage said first and second resilient seals.

* * * * *